US012312795B1

(12) United States Patent
Ren et al.

(10) Patent No.: US 12,312,795 B1
(45) Date of Patent: May 27, 2025

(54) BEAM-SLAB INTEGRATED PREFABRICATED WAFFLE SLAB STRUCTURE AND CONSTRUCTION METHOD THEREOF

(71) Applicant: Fujian Construction Engineering Prefabricated Building Research Institute Co., Ltd, Fuzhou (CN)

(72) Inventors: Yu Ren, Fuzhou (CN); Yajie Zhang, Fuzhou (CN); Siyuan Chi, Fuzhou (CN); Yujun Wu, Fuzhou (CN)

(73) Assignee: Fujian Construction Engineering Prefabricated Building Research Institute Co., Ltd, Fuzhou (CN)

( * ) Notice: Subject to any disclaimer, the term of this patent is extended or adjusted under 35 U.S.C. 154(b) by 0 days.

(21) Appl. No.: 19/036,360

(22) Filed: Jan. 24, 2025

(30) Foreign Application Priority Data

Jul. 12, 2024 (CN) ..... 202410934456.9

(51) Int. Cl.
*E04B 1/04* (2006.01)
*E04B 1/16* (2006.01)
*E04B 1/21* (2006.01)

(52) U.S. Cl.
CPC ..... *E04B 1/043* (2013.01); *E04B 1/167* (2013.01); *E04B 1/21* (2013.01); *E04B 2103/02* (2013.01)

(58) Field of Classification Search
CPC . E04B 1/043; E04B 1/16; E04B 1/167; E04B 1/21; E04B 1/41; E04B 2103/02; E04C 2/34; E04C 2/40
(Continued)

(56) References Cited

U.S. PATENT DOCUMENTS 924,703 A * 6/1909 Streed ..... E04B 1/04 361/651
1,314,271 A * 8/1919 Kopp ..... E04B 1/04 52/261
(Continued)

FOREIGN PATENT DOCUMENTS

CN 108678252 A 10/2018
CN 109469326 A 3/2019
(Continued)

OTHER PUBLICATIONS

CNIPA, Notification of First Office Action for CN202410934456.9, Aug. 29, 2024.
(Continued)

*Primary Examiner* — Brian D Mattei
*Assistant Examiner* — Joseph J. Sadlon
(74) *Attorney, Agent, or Firm* — Hemisphere Law, PLLC; Zhigang Ma

(57) ABSTRACT

A beam-slab integrated prefabricated waffle slab structure and a construction method thereof are provided, the structure includes columns, arranged in an array, and a beam and slab support element and a beam support element being disposed on each column; two ends of each prefabricated frame beam being respectively disposed on the beam support elements, a main support element being disposed on front and rear sidewalls of each prefabricated frame beam; prefabricated waffle beam-slab units, each disposed between the prefabricated frame beams. The construction method includes completing array construction of the columns; installing the beam and slab support element and the beam support element on each column; installing the prefabricated frame beam on two columns; installing the prefabricated waffle beam-slab units between the prefabricated frame beams; installing main beam top rebar skeletons and ribbed beam
(Continued)

top rebar skeletons; installing horizontal slab rebars and longitudinal slab rebars; and pouring concrete at nodes.

9 Claims, 14 Drawing Sheets

(58) Field of Classification Search
USPC ..... 52/282.1, 414
See application file for complete search history.

(56) References Cited

U.S. PATENT DOCUMENTS 1,353,373 A * 9/1920 Allbright ..... E04B 5/43 52/320
1,360,669 A * 11/1920 Jacob ..... A01G 9/1423 47/18
1,657,964 A * 1/1928 Groves ..... E04B 1/04 52/441
1,924,044 A * 8/1933 MacDougall ..... E04B 1/04 52/649.3
2,199,152 A * 4/1940 Edge ..... E04B 1/168 52/634
2,373,409 A * 4/1945 Wilbur ..... E04B 1/04 52/277
2,645,114 A * 7/1953 Amirikian ..... E04B 1/348 52/432
3,495,367 A * 2/1970 Kobayashi ..... E04C 2/06 52/406.1
3,613,325 A * 10/1971 Yee ..... E04B 1/20 52/236.8
3,672,022 A * 6/1972 York ..... B21F 27/005 428/116
3,693,308 A * 9/1972 Trezzini ..... E04B 1/0007 52/432
3,918,222 A * 11/1975 Bahramian ..... E04B 5/06 52/301
4,001,992 A * 1/1977 Rohss ..... E04B 1/165 52/745.12
4,023,315 A * 5/1977 Stucky ..... E04B 5/04 52/234
4,040,220 A * 8/1977 Henager ..... E04C 5/012 52/745.19
4,138,833 A * 2/1979 Townend ..... E04H 1/005 52/79.14
4,164,831 A * 8/1979 Messick ..... E04C 2/044 52/612
4,231,199 A * 11/1980 Gomez ..... E04B 1/04 52/204.2
4,372,906 A * 2/1983 del Valle ..... B28B 15/00 264/279.1
4,409,764 A * 10/1983 Wilnau ..... E04B 1/165 52/204.2
4,472,331 A * 9/1984 Kida ..... E04C 5/16 264/35
4,788,809 A * 12/1988 Koukourou ..... E04B 5/326 52/741.15
4,942,707 A * 7/1990 Huettemann ..... E04C 2/288 264/32
4,945,695 A * 8/1990 Majurinen ..... E04B 1/16 52/262
4,996,816 A * 3/1991 Wiebe ..... E04C 5/18 52/686
5,119,606 A * 6/1992 Graham ..... E04C 2/521 52/125.4
5,421,136 A * 6/1995 Van De Peer ..... E02D 27/08 52/294
6,000,194 A * 12/1999 Nakamura ..... B32B 3/28 52/783.17
6,003,279 A * 12/1999 Schneider ..... E04B 1/0046 403/231
6,101,779 A * 8/2000 Davenport ..... E04B 1/04 52/223.6
6,119,425 A * 9/2000 Shimonohara ..... E04B 1/21 52/439
6,266,938 B1 * 7/2001 Sheu ..... E04B 5/14 248/676
6,293,063 B2 * 9/2001 Van Doren ..... E04B 5/14 52/250
6,295,770 B1 * 10/2001 Sheu ..... E04C 5/04 52/649.3
6,543,371 B1 * 4/2003 Gardner ..... E04C 2/384 109/83
6,745,532 B1 * 6/2004 Vazquez Ruiz del Arbol ..... E01C 11/14 404/74
7,121,061 B2 * 10/2006 Jazzar ..... E04B 1/164 52/236.8
7,226,033 B2 * 6/2007 Foucher ..... E04B 1/0023 52/270
7,685,789 B2 * 3/2010 Houben ..... B28B 23/028 52/576
7,980,042 B2 * 7/2011 Polk, Jr. ..... B29C 31/047 403/252
8,110,134 B2 * 2/2012 Scott ..... B28B 7/24 249/126
8,505,267 B2 * 8/2013 Martin Hernandez ... E04B 5/43 52/749.11
8,782,993 B2 * 7/2014 Lawley ..... E04B 5/10 52/655.1
8,844,224 B2 * 9/2014 Lindquist ..... E04C 5/166 52/294
8,844,238 B2 * 9/2014 Baldoni ..... E04C 5/168 52/645
8,898,992 B2 * 12/2014 Rahimzadeh ..... E04B 1/30 52/745.15
8,943,776 B2 * 2/2015 Strickland ..... E04B 5/40 52/250
9,096,999 B2 * 8/2015 Rahimzadeh ..... E04C 3/293
9,506,266 B2 * 11/2016 Foldenauer ..... E04H 12/14
9,683,361 B2 * 6/2017 Timberlake ..... E04B 1/167
9,708,812 B2 * 7/2017 Jeske ..... E04B 2/96
10,094,101 B1 * 10/2018 Jazzar ..... E04C 3/34
10,125,457 B1 * 11/2018 Yin ..... E01D 19/125
10,145,130 B1 * 12/2018 Yin ..... E04B 5/18
10,151,111 B1 * 12/2018 Porter ..... E04B 2/14
10,202,770 B2 * 2/2019 Rapperstorfer ..... E04C 2/044
10,239,228 B2 * 3/2019 Hertz ..... B28B 19/003
10,260,225 B2 * 4/2019 Lee ..... E04C 5/0645
10,309,108 B2 * 6/2019 Sanabra Loewe ..... E04B 5/06
10,378,197 B2 * 8/2019 Kurosawa ..... E04B 1/30
10,400,450 B2 * 9/2019 Kim ..... E04B 5/40
10,538,384 B2 * 1/2020 Crowther ..... E04H 7/18
10,597,863 B2 * 3/2020 Slaven, Jr. ..... E04B 1/043
10,709,917 B2 * 7/2020 An ..... E04B 1/94
10,801,201 B2 * 10/2020 Pfeffer ..... E04B 9/06
10,808,393 B2 * 10/2020 Yin ..... E04B 1/164
10,837,175 B2 * 11/2020 Kim ..... E04C 5/073
11,053,675 B1 * 7/2021 Santandreu ..... E04B 5/17
11,105,084 B1 * 8/2021 Cui ..... E04C 3/293
11,352,786 B2 * 6/2022 Rahimian ..... E04B 1/161
11,414,863 B2 * 8/2022 Royce ..... B28B 23/046
11,566,424 B2 * 1/2023 Dinmore ..... E01D 21/00
11,578,491 B2 * 2/2023 Shaw ..... E04B 5/32
11,598,084 B2 * 3/2023 Foley ..... E01C 11/02
11,598,091 B2 * 3/2023 Mirkhani ..... E04B 1/16
11,702,836 B2 * 7/2023 Shiohara ..... E04B 1/4157 52/251
11,851,870 B2 * 12/2023 Lee ..... E04B 1/30
11,866,935 B2 * 1/2024 Ebisawa ..... E04B 5/38
12,012,756 B2 * 6/2024 Hulsizer ..... E04B 1/14
12,098,539 B2 * 9/2024 Zhang ..... E04B 1/483
12,129,653 B2 * 10/2024 Kang ..... E04B 1/06
2002/0092249 A1 * 7/2002 Yin ..... E04B 5/026 52/263
2003/0115822 A1 * 6/2003 Lejeune ..... E04B 5/04 52/309.12
2017/0051506 A1 * 2/2017 An ..... E04C 5/0631

(56) References Cited

U.S. PATENT DOCUMENTS

| | | | | |
|---|---|---|---|---|
| 2019/0177964 | A1* | 6/2019 | Yousefi Darestani | E04G 17/002 |
| 2024/0109224 | A1* | 4/2024 | Yin | E04B 5/21 |
| 2024/0110374 | A1* | 4/2024 | Searles | E04B 1/20 |

FOREIGN PATENT DOCUMENTS

| | | | |
|---|---|---|---|
| CN | 109695345 | A | 4/2019 |
| CN | 210238897 | U | 4/2020 |
| CN | 113123516 | A | 7/2021 |

OTHER PUBLICATIONS

Fujian Construction Engineering Prefabricated Building Research Institute Co., Ltd. (Applicant), Replacement claims (allowed) of CN202410934456.9, Sep. 19, 2024.

CNIPA, Notification to grant patent right for invention in CN202410934456.9, Sep. 27, 2024.

* cited by examiner

BEAM-SLAB INTEGRATED PREFABRICATED WAFFLE SLAB STRUCTURE AND CONSTRUCTION METHOD THEREOF

CROSS-REFERENCE TO RELATED APPLICATION

This application claims priority to Chinese Patent Application No. 202410934456.9, filed on Jul. 12, 2024, which is herein incorporated by reference in its entirety.

TECHNICAL FIELD

The disclosure relates to the technical field of prefabricated modular building structures, and more particularly to a beam-slab integrated prefabricated waffle slab structure and a construction method thereof.

BACKGROUND

In current high-tech electronic factories, such as chip processing factories or panel factories, the floor slabs need to meet the requirements of anti-micro-vibration, that is, the floor slabs cannot vibrate slightly during the production process to avoid affecting product production and ensure the yield rate of products. In order to achieve the anti-micro-vibration effect, a thickness of the factory floor slabs is much higher than that of ordinary buildings. In addition, since most high-tech electronic factories are high-cleanliness factories, it is necessary to open multiple through-holes on the floor slabs to control the air flow in the factory and ensure the requirements for air cleanliness.

At present, the floor slabs of the high-tech electronic factories are mainly cast-in-place, and the cast-in-place process requires the floor slabs to meet the following requirements. 1. The flatness of the slab surface is high, and the error within two meters (m) does not exceed two millimeters (mm). 2. The surface needs to be leveled. 3. During the construction process, in addition to laying out the external formwork, it is also necessary to lay out the circular hole mold, and then tie the rebars for overall pouring.

However, the above requirements have the following problems.

1. Due to the high construction requirements, for example, the flatness of the lower surface of the floor slab requires the use of a black plastic template, and the upper surface of the floor slab needs to be leveled, the on-site construction is difficult, the construction period is long, and the quality of the construction personnel is required to be high.

2. The floor slabs of the high-tech electronic factories are large in area and high in height, the cast-in-place process requires a large-scale support system, which is slow and expensive to construct.

3. The cast-in-place process requires that the formwork and support be removed only after the concrete has hardened, and only then can the equipment be installed. The construction period is long, which seriously affects the project delivery time and it is difficult to meet the requirements for high-tech production lines to be put into production as soon as possible.

A Chinese patent publication No. CN109469326A discloses a construction method for special-shaped lattice panels, and the lattice panels disclosed therein are used as floor slabs of wafer factories. A Chinese patent publication No. CN109695345A discloses a structural construction method of building, and the precast floors disclosed therein are used as floor slabs of factories. However, both the lattice panels and the precast floors have a planar size close to the column grid size. According to the current technology, the column grid size is usually 6 m*6 m, thus they are basically not suitable for road transportation. In addition, the floor slabs disclosed in the above patents are large in size and have few post-cast layers, thus they are heavy overall, and the corresponding transportation and installation costs are high.

SUMMARY

A purpose of the disclosure is to provide a beam-slab integrated prefabricated waffle slab structure, which achieves the construction site without support and formwork through prefabricated assembly while meeting requirements of anti-micro-vibration, significantly accelerating construction progress and reducing construction costs.

A beam-slab integrated prefabricated waffle slab structure includes columns, prefabricated frame beams and prefabricated waffle beam-slab units.

The columns are arranged in an array, and a beam and slab support element and a beam support element are disposed on an upper end of each of the columns.

A cross section of each of the prefabricated frame beams is generally rectangular, two ends of each of the prefabricated frame beams are respectively disposed on the beam support elements of adjacent columns on left and right sides of each of the prefabricated frame beams, and a main support element is disposed on front and rear sidewalls of each of the prefabricated frame beams.

Each of the prefabricated waffle beam-slab units includes a reinforced concrete slab, ribbed beams, annular bars, cylindrical inner molds and a pre-embedded steel plate. The ribbed beams are respectively disposed on left and right sides of the reinforced concrete slab, and are disposed facing upwards and extend forwards and backwards. The reinforced concrete slab defines through-holes arranged in an array. The annular rebars extending out of the reinforced concrete slab are disposed on front and rear sides and left and right sides of any one of the through-holes, and the annular rebar between any adjacent two of the through-holes is the same. An upper end of each of the through-holes is provided with the cylindrical inner mold to obtain array arranged cylindrical inner molds. The pre-embedded steel plate is disposed on each of inner sidewalls of front and rear ends of each of the ribbed beams. One of the ribbed beams of each of the prefabricated waffle beam-slab units is disposed on the beam and slab support elements, and another of the ribbed beams of each of the prefabricated waffle beam-slab units is disposed on the main support elements of two mutually parallel prefabricated frame beams.

Each of the ribbed beams is provided with stirrups B, and the stirrups B extend out of an upper surface of each of the ribbed beams, and are arranged in a front to back sequence. A post-installed ribbed beam top rebar skeleton is disposed on adjacent two of the ribbed beams of two of the prefabricated waffle beam-slab units.

A top surface of each of the prefabricated frame beams defines a groove extending along a length direction of each of the prefabricated frame beams. Each of the prefabricated frame beams is provided with opening hoops extending out of the groove, and is provided with connecting rebars extending out of front and rear sides of each of the prefabricated frame beams. The connecting rebars are provided in multiple rows, and the multiple rows of the connecting rebars are arranged in a left to right sequence. Each of the prefabricated frame beams is provided with longitudinal rebars A therein, and each of the longitudinal rebars A extends into beam-column nodes of the columns and the prefabricated frame beams.

Post-installed main beam top rebar skeletons are disposed on the prefabricated frame beams, each of the main beam top rebar skeletons is disposed continuously to cover all of the prefabricated frame beams in a same extension direction, and each of the main beam top reinforcement skeletons and the opening hoops cooperate to form a closed hoop structure.

An L-shaped connecting element is disposed between the pre-embedded steel plate and a corresponding one main support element, and the L-shaped connecting element is welded with the pre-embedded steel plate and the corresponding one main support element. In the array arranged cylindrical inner molds, horizontal slab rebars are disposed between horizontal gaps of the array arranged cylindrical inner molds, and longitudinal slab rebars are disposed between longitudinal gaps of the array arranged cylindrical inner molds.

Concrete is poured on site at the beam-column nodes of the columns and the prefabricated frame beams, at the ribbed beam top rebar skeletons, at the main beam top rebar skeleton, at the horizontal slab rebars and at the longitudinal slab rebars, and the poured-on-site concrete is configured to cover the ribbed beam top rebar skeletons, the main beam top rebar skeletons, the horizontal slab rebars and the longitudinal slab rebars.

A construction method of the beam-slab integrated prefabricated waffle slab structure, including:

S1, completing array construction of the columns;

S2, installing the beam and slab support element and the beam support element on each of the columns according to heights of the prefabricated frame beams and the prefabricated waffle beam-slab units;

S3, installing each of the prefabricated frame beams on two of the columns to make ends of each of the prefabricated frame beams be supported on the beam support elements of the two of the columns;

S4, installing each of the prefabricated waffle beam-slab units on two of the prefabricated frame beams to make the ribbed beam on a side of each of the prefabricated waffle beam-slab units be supported on the beam-slab support elements and make the ribbed beam on another side of each of the prefabricated waffle beam-slab units be supported on the main support element;

S5, welding the L-shaped connecting element with the pre-embedded steel plate and the main support element; installing the main beam top rebar skeletons in the groove of each of the prefabricated frame beams, where the main beam top rebar skeletons cover all of the prefabricated frame beams in the same extension direction; and installing the ribbed beam top rebar skeleton in the adjacent two of the ribbed beams of two of the prefabricated waffle beam-slab units;

S6, installing the horizontal slab rebars and the longitudinal slab rebars into each of the prefabricated waffle beam-slab units in sequence; and

S7, pouring the concrete at the beam-column nodes of the columns and the prefabricated frame beams, at the ribbed beam top rebar skeletons, at the main beam top rebar skeletons, at the horizontal slab rebars and at the longitudinal slab rebars on site, where the poured-on-site concrete is configured to cover the ribbed beam top rebar skeletons, the main beam top rebar skeletons, the horizontal slab rebars and the longitudinal slab rebars.

Compared to the related art, beneficial effects of the disclosure are as follows.

1. The disclosure replaces a composite slab area of an existing beam-slab integrated unit with a prefabricated waffle beam-slab unit. Compared with the traditional construction method, the disclosure can achieve support-free and formwork-free construction on the construction site, significantly improving the installation speed. In addition, the prefabricated waffle beam-slab unit is prefabricated using factory standardization, which significantly reduces the difficulty of later plate surface leveling and maximizes the construction speed.

2. The combination of the prefabricated waffle beam-slab units and post-poured concrete is convenient and has good integrity, which can ensure the anti-micro-vibration and waterproof performance of the prefabricated floor.

3. The prefabricated waffle beam-slab units are lighter in weight than fully prefabricated waffle slabs, can meet the size restrictions for road transportation, are cheap in transportation costs and are easy to install.

4. The main support element adopts an inverted T-shaped structural design to ensure that the prefabricated frame beam is flush with the bottom of the main support element, which does not affect the installation of subsequent production equipment. At the same time, it has a large bearing capacity and is easy to install.

5. The ribbed beam top rebar skeletons, the main beam top rebar skeletons, the horizontal slab rebars, and the longitudinal slab rebars are connected with the corresponding structures, which is convenient for installation and ensures the reliability of the connection between each component.

DESCRIPTION OF REFERENCE SIGNS

Figure 1:
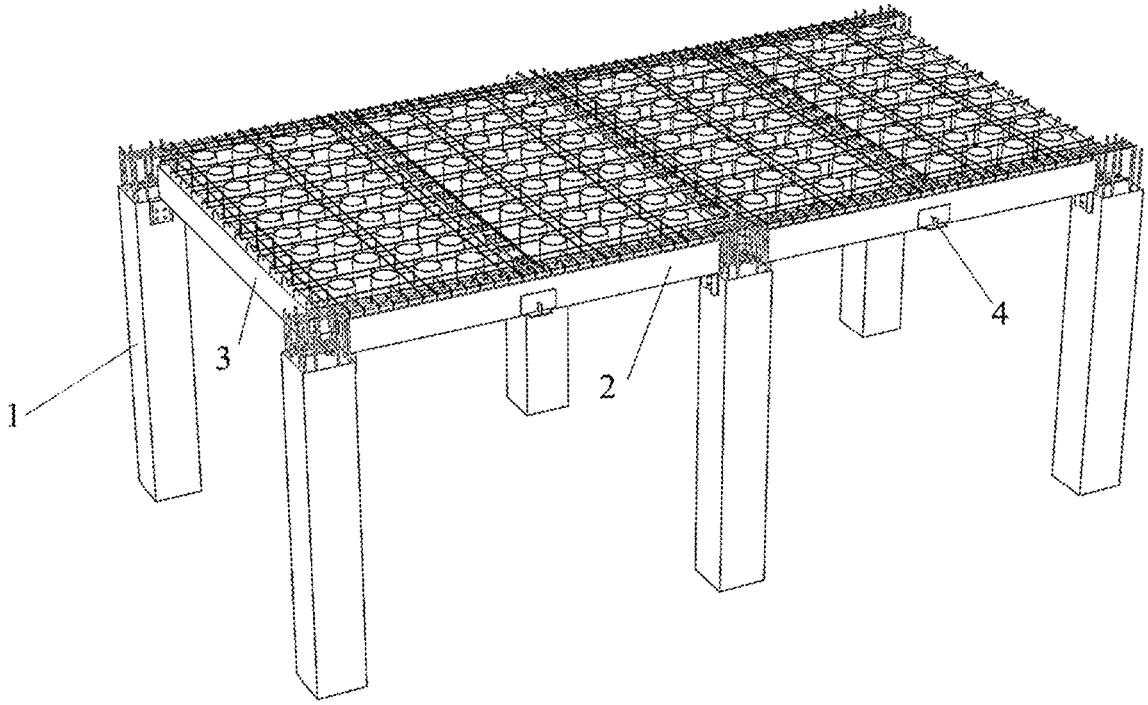
FIG. 1 illustrates an overall schematic structural diagram of a beam-slab integrated prefabricated waffle slab structure according to an embodiment of the disclosure.
Figure 2:
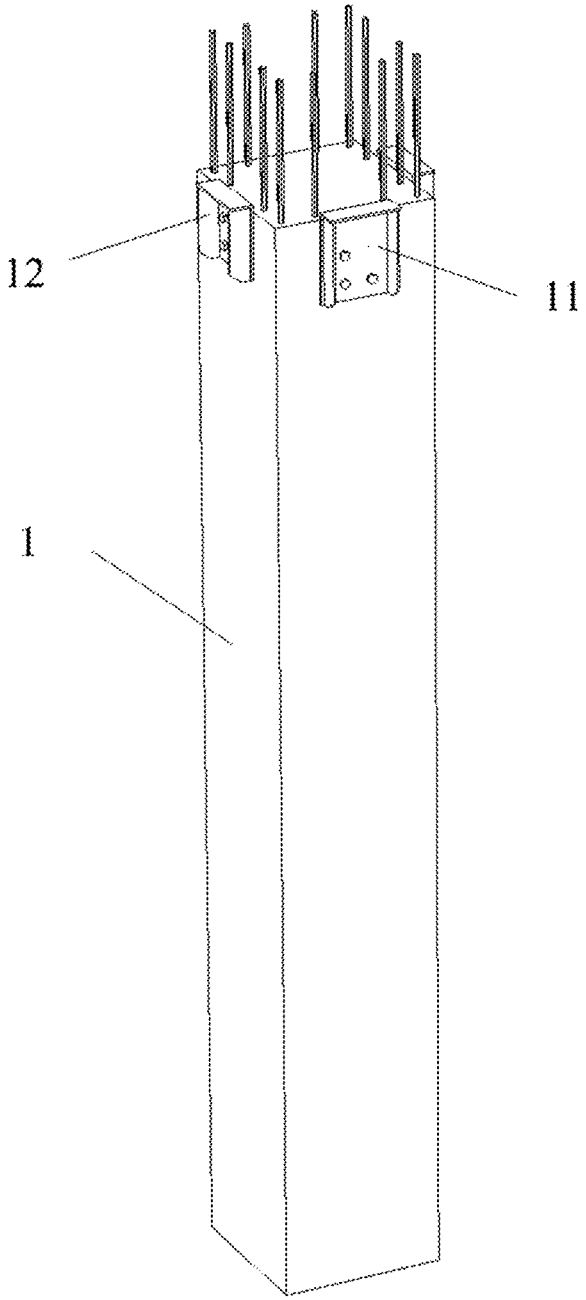
FIG. 2 illustrates a schematic structural diagram of a column of the beam-slab integrated prefabricated waffle slab structure according to an embodiment of the disclosure.
Figure 3:
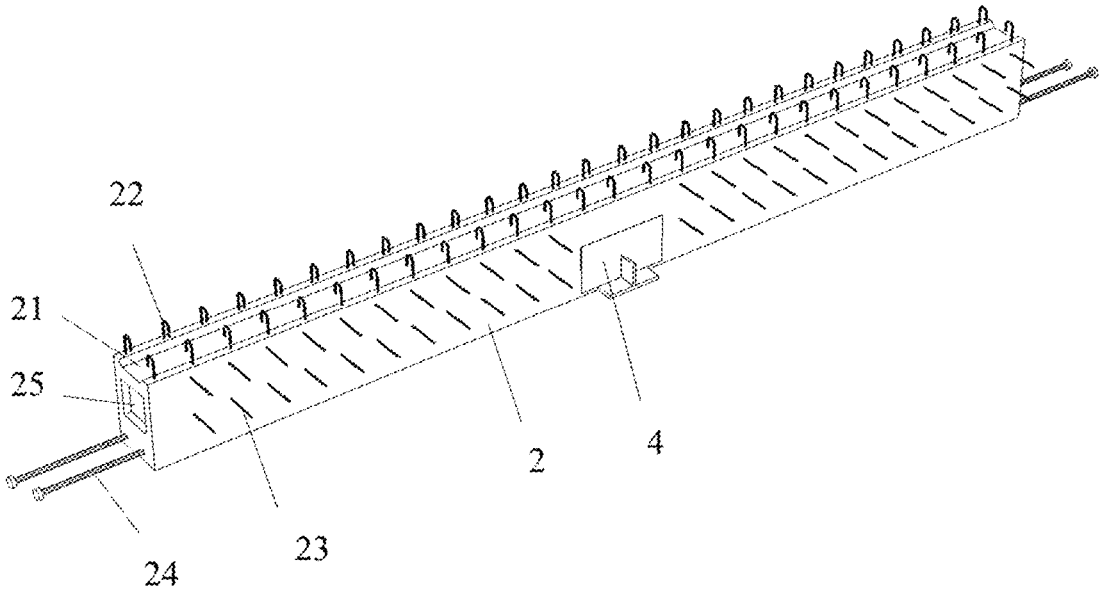
FIG. 3 illustrates a schematic structural diagram of a prefabricated frame beam of the beam-slab integrated prefabricated waffle slab structure according to an embodiment of the disclosure.

1—column; 11—beam and slab support element; 12—beam support element;

2—prefabricated frame beam; 21—groove; 22—opening hoop; 23—connecting rebar; 24—longitudinal rebar A; 25—shear resistant keyway A;

3—prefabricated waffle beam-slab unit; 31—reinforced concrete slab; 32—ribbed beam; 321—stirrup B; 322—longitudinal rebar B; 323—shear resistant keyway B; 33—through-hole; 34—annular rebar; 35—cylindrical inner mold; 36—pre-embedded steel plate; 37—slab bottom horizontal rebar; 371—lower horizontal rebar; 372—lower horizontal stirrup; 38—slab bottom longitudinal rebar; 381—lower longitudinal rebar; 382—lower longitudinal stirrup; 39—ribbed beam rebar; 391—ribbed beam stirrup;

4—main support element; 41—anchor plate; 42—shear resistant steel plate; 43—connecting bottom plate; 44—vertical steel plate;

5—ribbed beam top rebar skeleton; 51—continuous rebar A; 52—closure stirrup;

6—main beam top rebar skeleton; 61—continuous rebar B; 62—lacing wire;

7—horizontal slab rebar; 71—upper horizontal rebar; 72—upper horizontal stirrup;

8—longitudinal slab rebar; 81—upper longitudinal rebar; 82—upper longitudinal stirrup;

9—L-shaped connecting element.

DETAILED DESCRIPTION OF EMBODIMENTS

The disclosure is described in detail in conjunction with embodiments and drawings below.

As shown in FIGS. 1-19, a beam-slab integrated prefabricated waffle slab structure includes columns 1, prefabricated frame beams 2, and prefabricated waffle beam-slab units 3.

The columns 1 are arranged in an array, and a beam and slab support element 11 and a beam support element 12 are disposed on an upper end of each of the columns 1.

A cross section of each of the prefabricated frame beams 2 is generally rectangular, two ends of each prefabricated frame beam 2 are respectively disposed on the beam support elements 12 of adjacent columns 1 on left and right sides of each prefabricated frame beam 2, and a main support element 4 is disposed on front and rear sidewalls of each prefabricated frame beam 2.

Each prefabricated waffle beam-slab unit 3 includes a reinforced concrete slab 31, ribbed beams 32, annular bars 34, cylindrical inner molds 35 and a pre-embedded steel plate 36. The ribbed beams 32 are respectively disposed on left and right sides of the reinforced concrete slab 31, and are disposed facing upwards and extend forwards and backwards. The reinforced concrete slab 31 defines through-holes 33 arranged in an array. The annular rebars 34 extending out of the reinforced concrete slab 31 are disposed on front and rear sides and left and right sides of any one of the through-holes 33, and the annular rebar 34 between any adjacent two of the through-holes 33 is the same. An upper end of each of the through-holes 33 is provided with the cylindrical inner mold 35 to obtain array arranged cylindrical inner molds 35. The pre-embedded steel plate 36 is disposed on each of inner sidewalls of front and rear ends of each of the ribbed beams 32. One of the ribbed beams 32 of each prefabricated waffle beam-slab unit 3 is disposed on the beam and slab support elements 11, and another of the ribbed beams 32 of each prefabricated waffle beam-slab unit 3 is disposed on the main support elements 4 of two mutually parallel prefabricated frame beams 2.

Each of the ribbed beams 32 is provided with stirrups B 321, and the stirrups B 321 extend out of an upper surface of each of the ribbed beams 32, and are arranged in a front to back sequence. A post-installed ribbed beam top rebar skeleton 5 is disposed on adjacent two of the ribbed beams 32 of two of the prefabricated waffle beam-slab units 3.

A top surface of each prefabricated frame beam 2 defines a groove 21 extending along a length direction of each prefabricated frame beam 2. Each prefabricated frame beam 2 is provided with opening hoops 22 extending out of the groove 21, and is provided with connecting rebars 23 extending out of front and rear sides of each prefabricated frame beam 2. The connecting rebars 23 are provided in multiple rows, and the multiple rows of the connecting rebars 23 are arranged in a left to right sequence. Each prefabricated frame beam 2 is provided with longitudinal rebars A 24 therein, and each of the longitudinal rebars A 24 extends into beam-column nodes (i.e., the connection points between the columns 1 and the prefabricated frame beams 2) of the columns 1 and the prefabricated frame beams 2.

Post-installed main beam top rebar skeletons 6 are disposed on the prefabricated frame beams 2, each of the main beam top rebar skeletons 6 is disposed continuously to cover all of the prefabricated frame beams 2 in a same extension direction, and each of the main beam top reinforcement skeletons and the opening hoops 22 cooperate to form a closed hoop structure.

An L-shaped connecting element 9 is disposed between the pre-embedded steel plate 36 and a corresponding one main support element 4, and the L-shaped connecting element 9 is welded with the pre-embedded steel plate 36 and the corresponding one main support element 4. In the array arranged cylindrical inner molds 35, horizontal slab rebars 7 are disposed between horizontal gaps of the array arranged cylindrical inner molds 35, and longitudinal slab rebars 8 are disposed between longitudinal gaps of the array arranged cylindrical inner molds 35.

Concrete is poured on site at the beam-column nodes of the columns 1 and the prefabricated frame beams 2, at the ribbed beam top rebar skeletons 5, at the main beam top rebar skeletons 6, at the horizontal slab rebars 7 and at the longitudinal slab rebars 8, and the poured-on-site concrete is configured to cover the ribbed beam top rebar skeletons 5, the main beam top rebar skeletons 6, the horizontal slab rebars 7 and the longitudinal slab rebars 8.

The columns 1 and the prefabricated frame beams 2 here are not much different from the traditional beam-slab integrated unit structure. The main difference lies in the structure of the prefabricated waffle beam-slab unit and the design of related configurations.

The prefabricated waffle beam-slab unit 3 remains a breathable channel, and the cylindrical inner molds 35 are directly poured on the prefabricated waffle beam-slab unit 3. The concaved area in the middle of the prefabricated waffle beam-slab unit 3 is matched with horizontal slab rebars 7 and longitudinal slab rebars 8, and are poured with concrete on site, thereby ensuring the thickness of the formed floor slab and the anti-micro-vibration effect, while ensuring that the prefabricated components are not too heavy.

Rebars in each prefabricated waffle beam-slab unit 3 include: multiple slab bottom horizontal rebars 37, multiple slab bottom longitudinal rebars 38 and ribbed beam rebars 39.

The multiple slab bottom horizontal rebars 37 are arranged horizontally in parallel intervals, the multiple slab bottom longitudinal rebars 38 are arranged longitudinally in parallel intervals, and the multiple slab bottom horizontal rebars 37 and the multiple slab bottom longitudinal rebars 38 are arranged in a staggered manner and are poured with the concrete, with reservation of the through-holes 33 to form the reinforced concrete slab 31. The ribbed beam rebars 39 are poured with the concrete to form the ribbed beams 32.

Each of the multiple slab bottom horizontal rebars 37 includes lower horizontal rebars 371 and lower horizontal stirrups 372. Multiple lower horizontal rebar 371 extend left and right and are bent at two ends to form an anchorage structure extending into the ribbed beams 32, multiple lower horizontal stirrups 372 are arranged in a left to right sequence, and the lower horizontal rebars 371 are connected to bottoms of the lower horizontal stirrups 372.

Each of the multiple slab bottom longitudinal rebars 38 includes lower longitudinal rebars 381 and lower longitudinal stirrups 382. Multiple lower longitudinal rebars 381 extend left and right, multiple lower longitudinal stirrups 382 are arranged in a front to rear sequence, and the lower longitudinal rebars 381 are connected to bottoms of the lower longitudinal stirrups 382.

Each of the ribbed beam rebars 39 includes longitudinal rebars B 322 and ribbed beam stirrups 391. Tops of the ribbed beam stirrups 391 extend out of the upper surface of each of the ribbed beams 32 to form the stirrups B 321. The ribbed beams 32 cooperating with the beam and slab support elements 11 are provided with the longitudinal rebars B 322 therein, and the longitudinal rebars B 322 extend into the beam-column nodes of the columns 1 and the prefabricated frame beams 2.

Front and rear end surfaces of the ribbed beams 32 cooperating with the beam and slab support elements 11 each define a shear resistant keyway B 323.

Left and right end surfaces of each prefabricated frame beam 2 each define a shear resistant keyway A 25. The shear resistant keyway B 323 and the shear resistant keyway A 25 here are mainly used to ensure the intensity of the connections of the pouring nodes.

Figure 4:
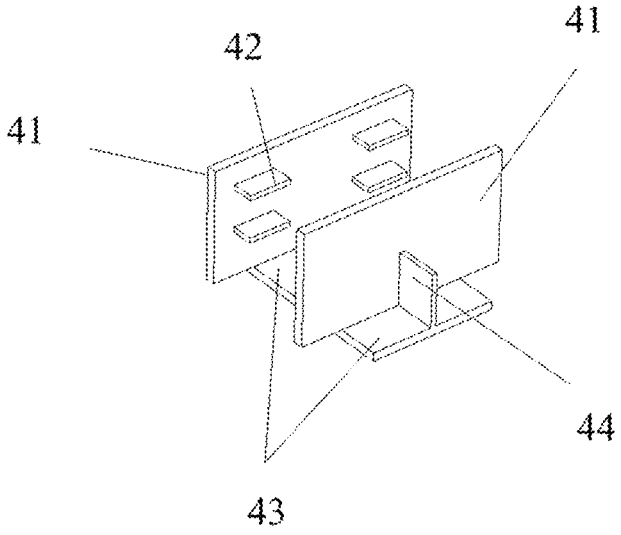
FIG. 4 illustrates a schematic structural diagram of a main support element of the beam-slab integrated prefabricated waffle slab structure according to an embodiment of the disclosure.
Figure 5:
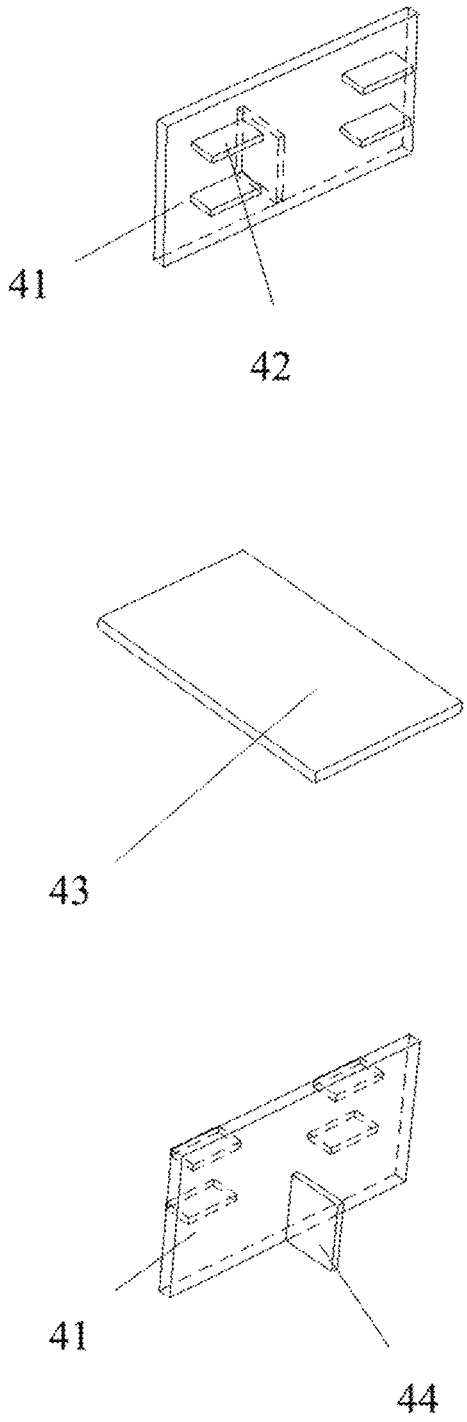
FIG. 5 illustrates an exploded view of the main support element of the beam-slab integrated prefabricated waffle slab structure according to an embodiment of the disclosure.
Figure 6:
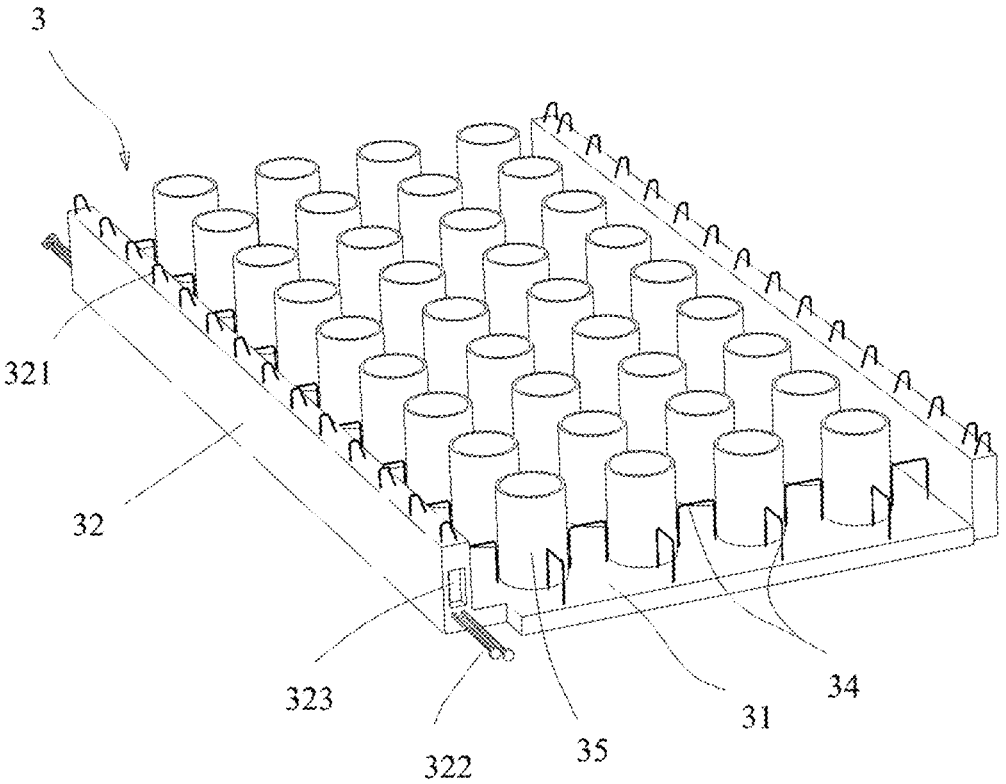
FIG. 6 illustrates a schematic structural diagram of a prefabricated waffle beam-slab unit of the beam-slab integrated prefabricated waffle slab structure according to an embodiment of the disclosure.
Figure 7:
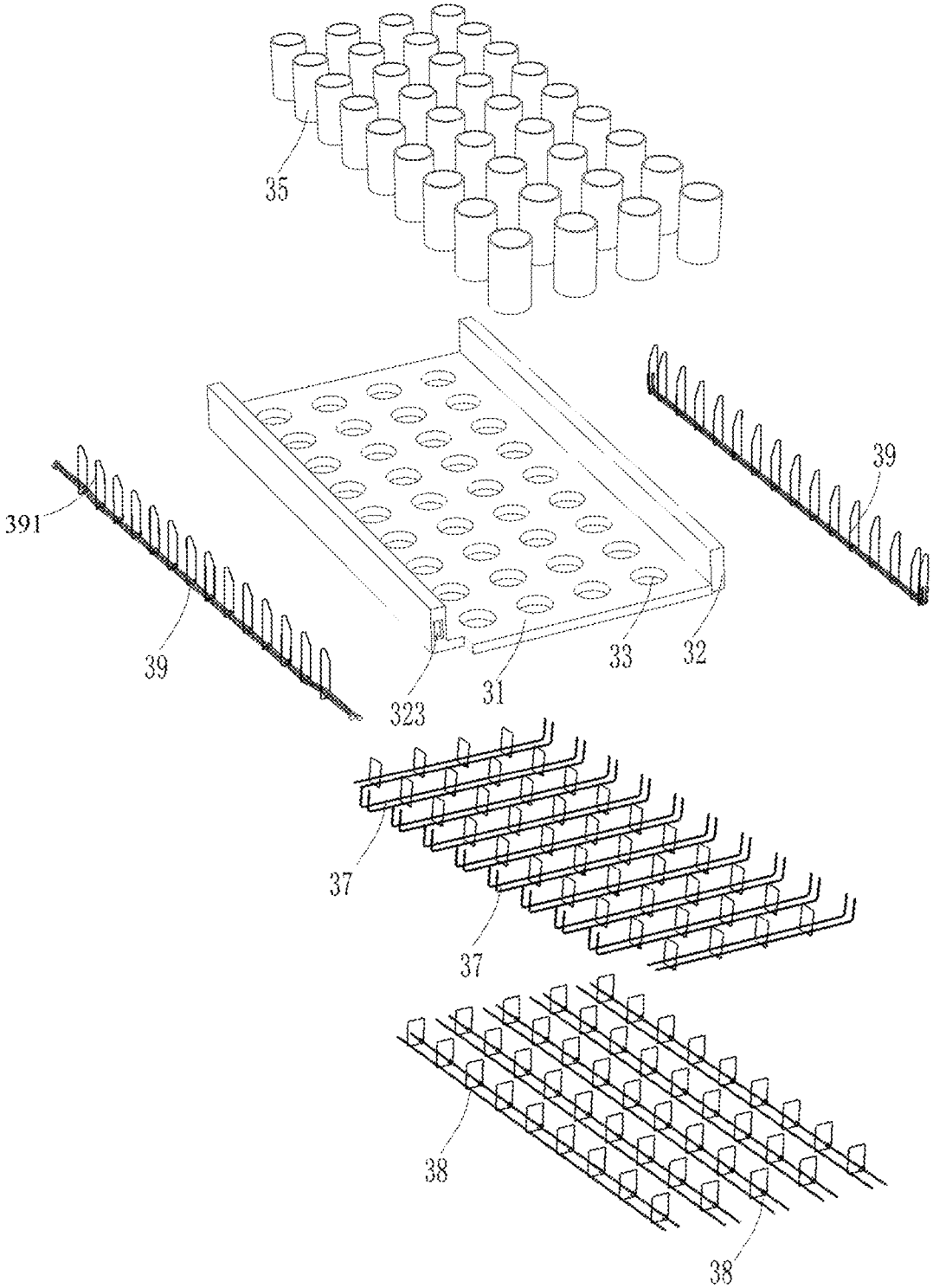
FIG. 7 illustrates an exploded view of FIG. 6.
Figure 8:
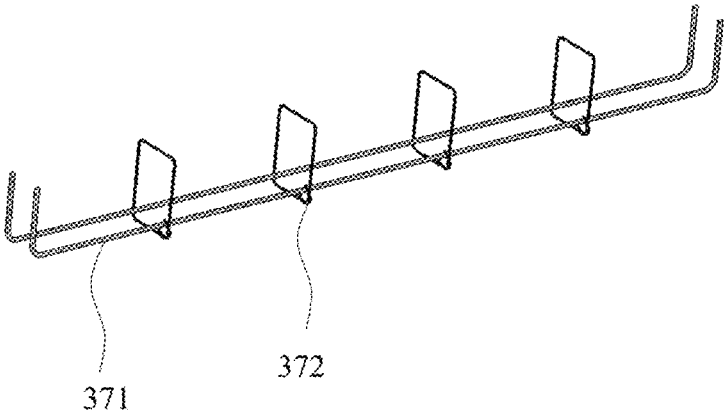
FIG. 8 illustrates a schematic structural diagram of a slab bottom horizontal rebar of the beam-slab integrated prefabricated waffle slab structure according to an embodiment of the disclosure.
Figure 9:
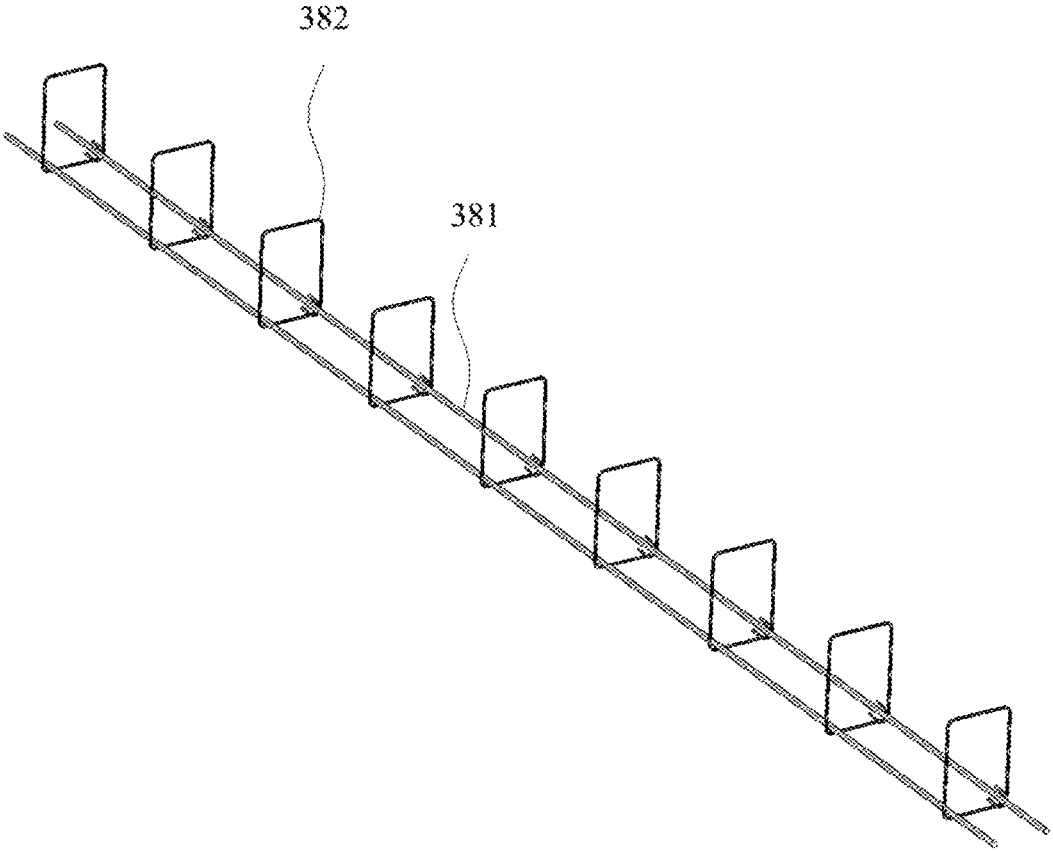
FIG. 9 illustrates a schematic structural diagram of a slab bottom longitudinal rebar of the beam-slab integrated prefabricated waffle slab structure according to an embodiment of the disclosure.

As shown in FIGS. 4 and 5, the main support element includes two anchor plates 41, shear resistant steel plates 42, a connecting bottom plate 43 and vertical steel plates 44. The shear resistant steel plates 42 are fixed to an inner side surface of each of the two anchor plates 41, and the two anchor plates 41 are respectively disposed on front and rear side surfaces of each prefabricated frame beam 2. Bottoms of the two anchor plates 41 are connected by the connecting bottom plate 43. The main support element 4 and each prefabricated frame beam 2 are integrally cast and molded.

Front and rear edges of the connecting bottom plate 43 each extend out of the front and rear side surfaces of each prefabricated frame beam 2. Each of the vertical steel plates 44 is connected to a middle of the connecting steel plate 43 and is connected to an outer side surface of each of the two anchor plates 41 to form an inversed T-shaped support structure, to thereby make two sides of each of the vertical steel plate 44 respectively support the ribbed beams 32 of corresponding reinforced concrete slabs 31.

Since the shear resistance of the inverted T-shaped support structure is lower than that of the trough-shaped support structure of the existing beam-slab integrated slab, it is considered to provide the L-shaped connecting element 9 between the pre-embedded steel plate 36 and the main support element 4 and weld them to improve the shear resistance.

Figure 11:
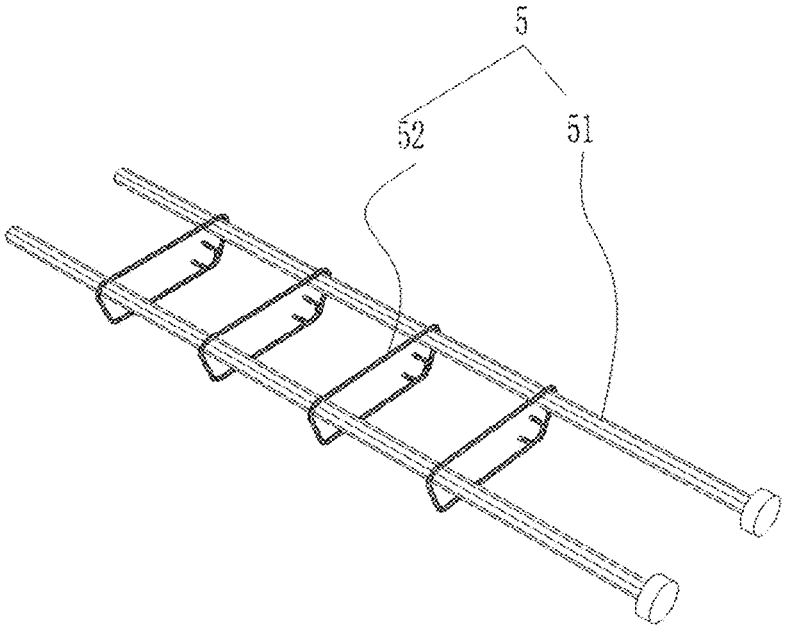
FIG. 11 illustrates a schematic structural diagram of a ribbed beam top rebar skeleton of the beam-slab integrated prefabricated waffle slab structure according to an embodiment of the disclosure.

As shown in FIG. 11, the ribbed beam top rebar skeleton 5 includes continuous rebars A 51 and closure stirrups 52. Multiple continuous rebars A 51 are arranged in parallel, multiple closure stirrups 52 are disposed between the continuous rebars A 51, and are arranged along an extension direction of the continuous rebars A 51 in sequence. The closure stirrups 52 and the stirrups B 321 of the ribbed beam top rebar skeleton 5 are arranged in a staggered manner.

Figure 10:
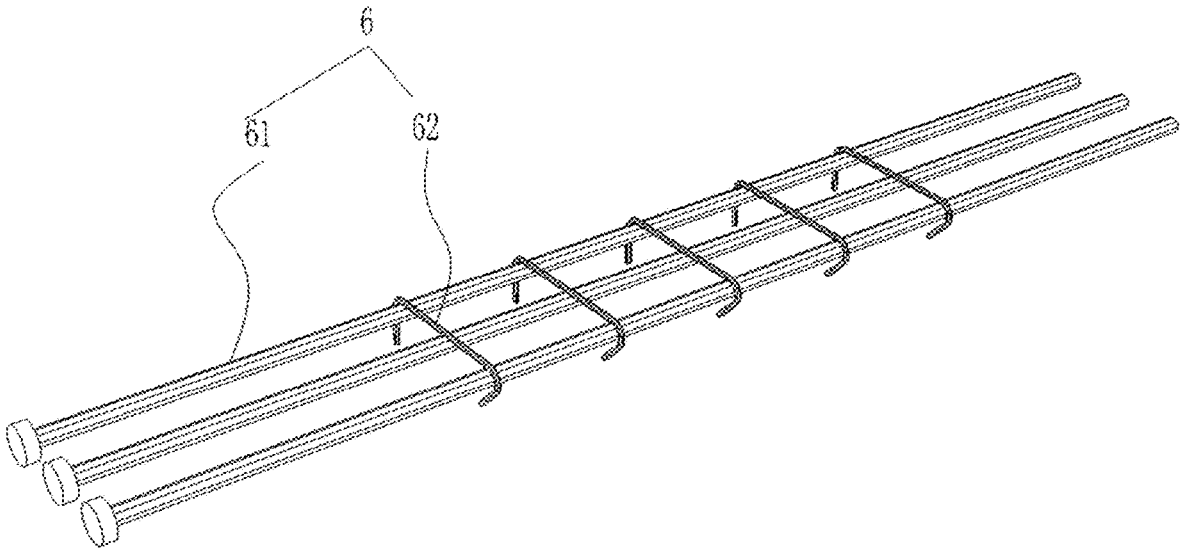
FIG. 10 illustrates a schematic structural diagram of a main beam top rebar skeleton of the beam-slab integrated prefabricated waffle slab structure according to an embodiment of the disclosure.

As shown in FIG. 10, the main beam top rebar skeleton 6 includes continuous rebars B 61 and lacing wires 62. Multiple continuous rebars B 61 are arranged in an array, and the lacing wires 62 are disposed outside the continuous rebars B 61. The lacing wires 62 are arranged along an extension direction of the continuous rebars B 61 in sequence.

Figure 13:
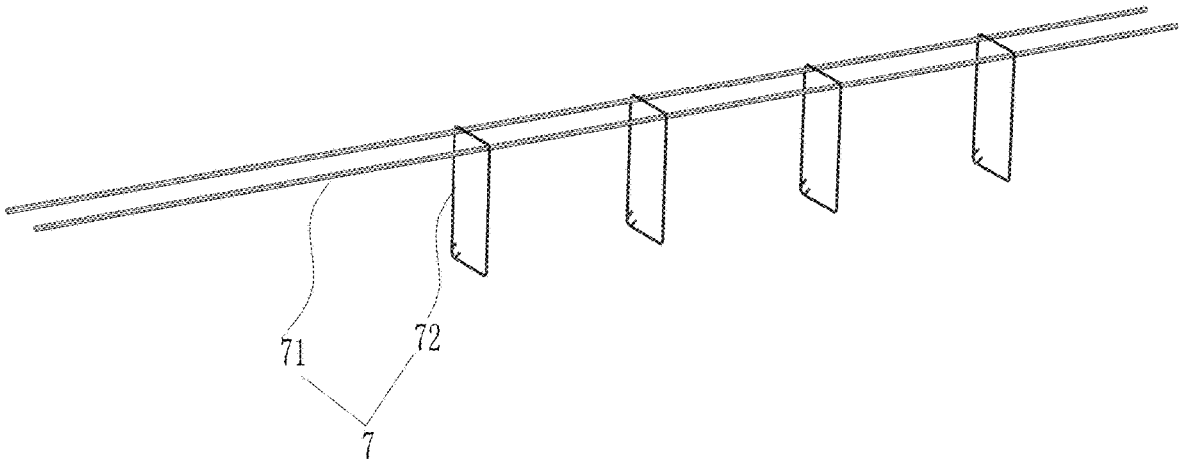
FIG. 13 illustrates a schematic structural diagram of a horizontal slab rebar of the beam-slab integrated prefabricated waffle slab structure according to an embodiment of the disclosure.
Figure 14:
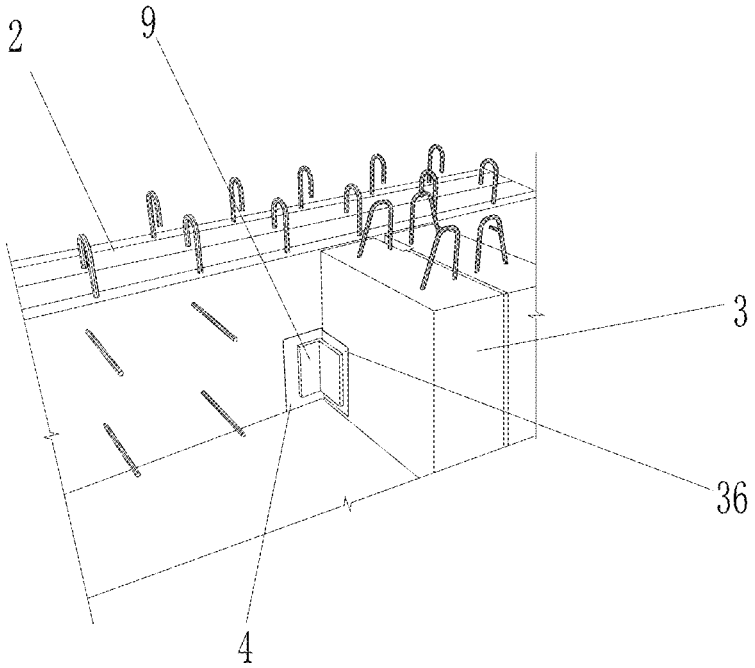
FIG. 14 illustrates a schematic structural diagram of a connection between a pre-embedded steel plate and the main support element according to an embodiment of the disclosure.
Figure 15:
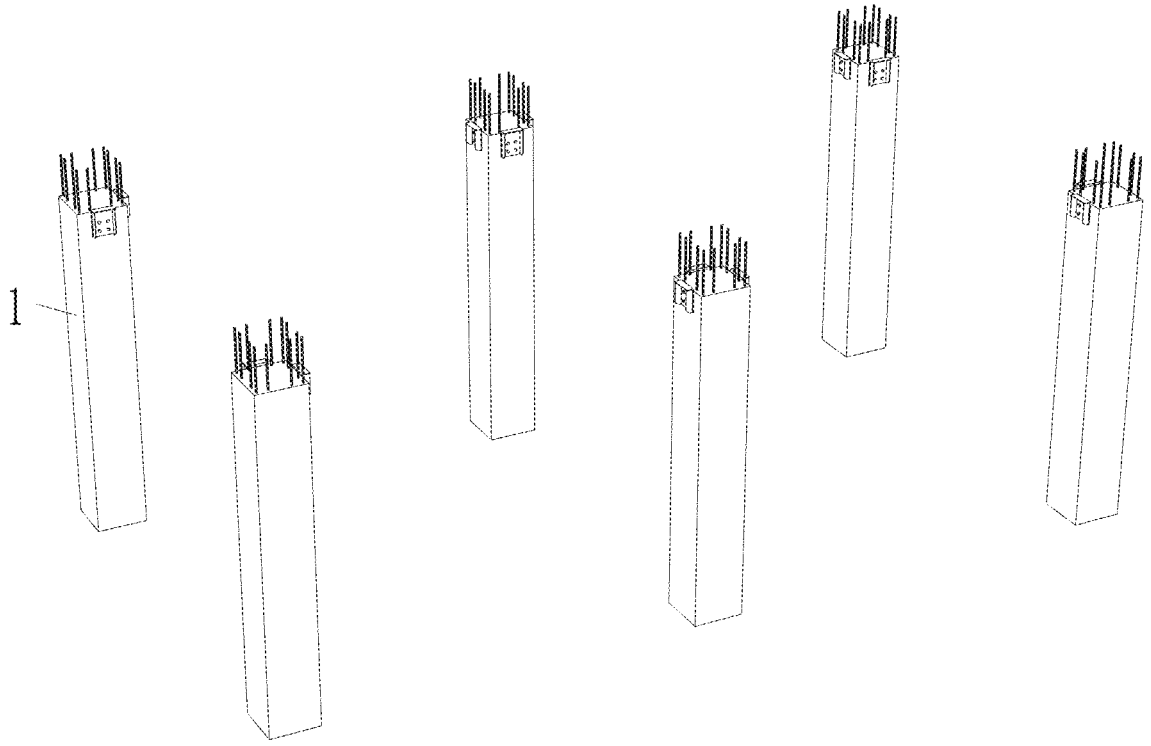
FIG. 15 illustrates a schematic diagram of construction procedures of steps 1 and 2 according to an embodiment of the disclosure.
Figure 16:
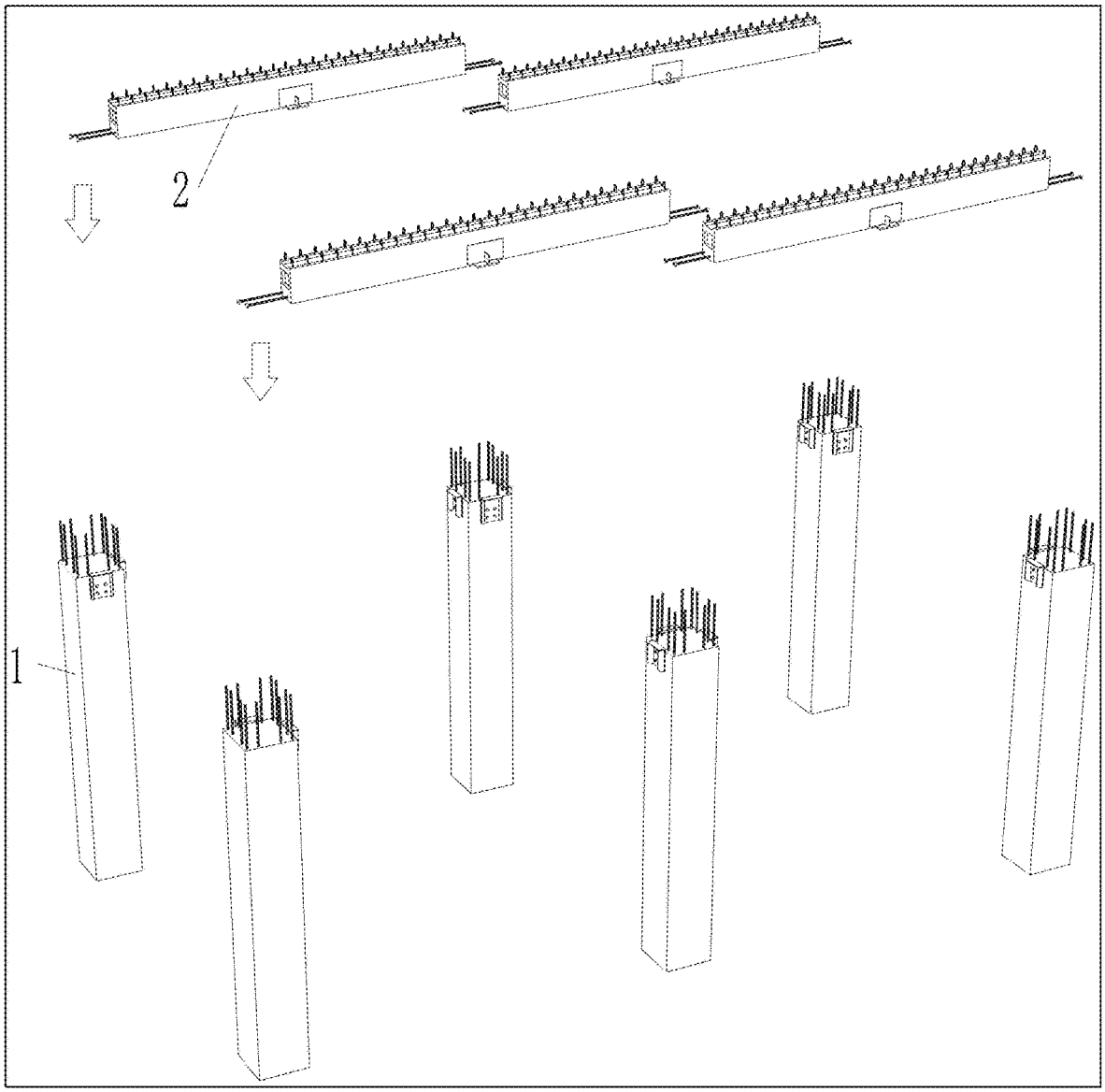
FIG. 16 illustrates a schematic diagram of construction procedures of a step 3 according to an embodiment of the disclosure.
Figure 17:
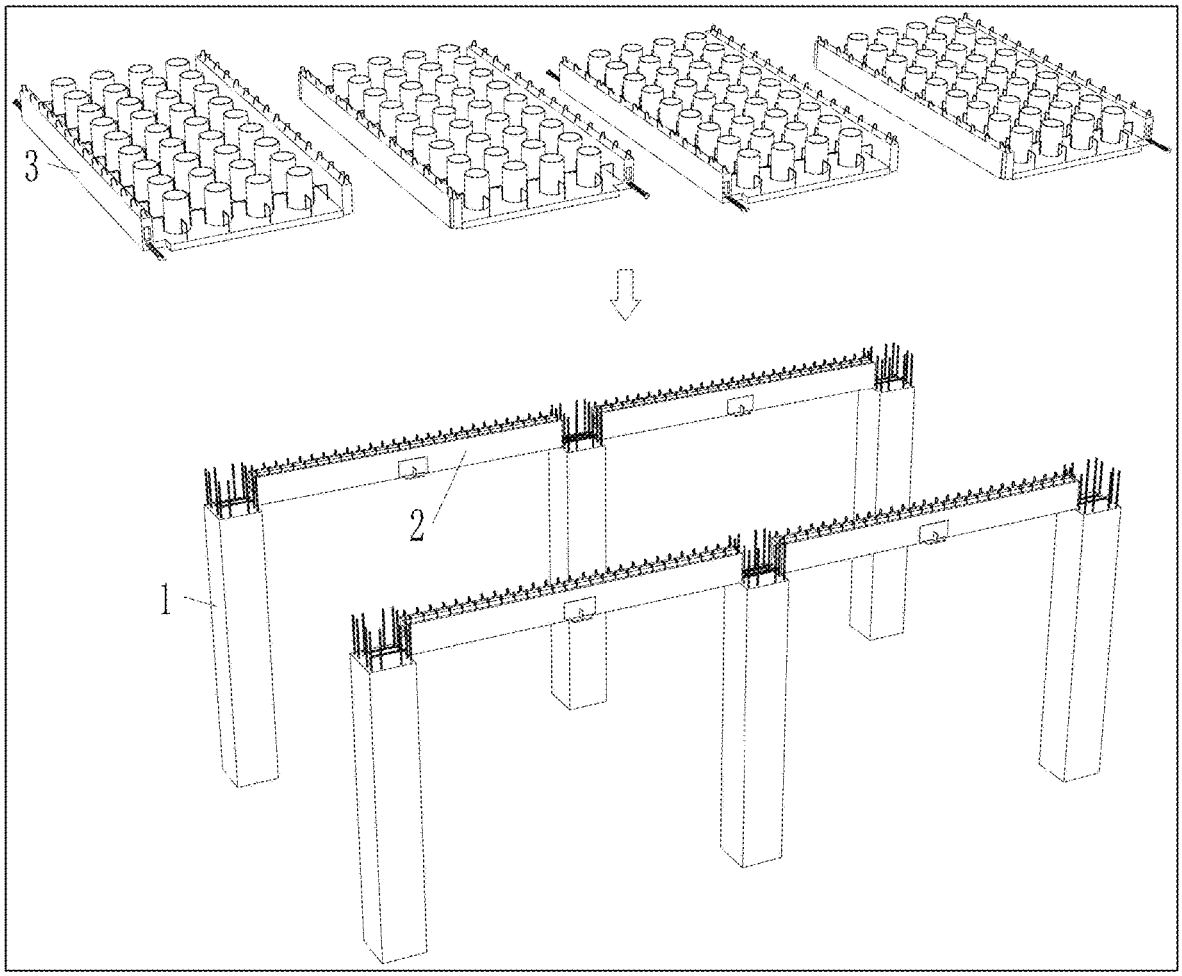
FIG. 17 illustrates a schematic diagram of construction procedures of a step 4 according to an embodiment of the disclosure.
Figure 18:
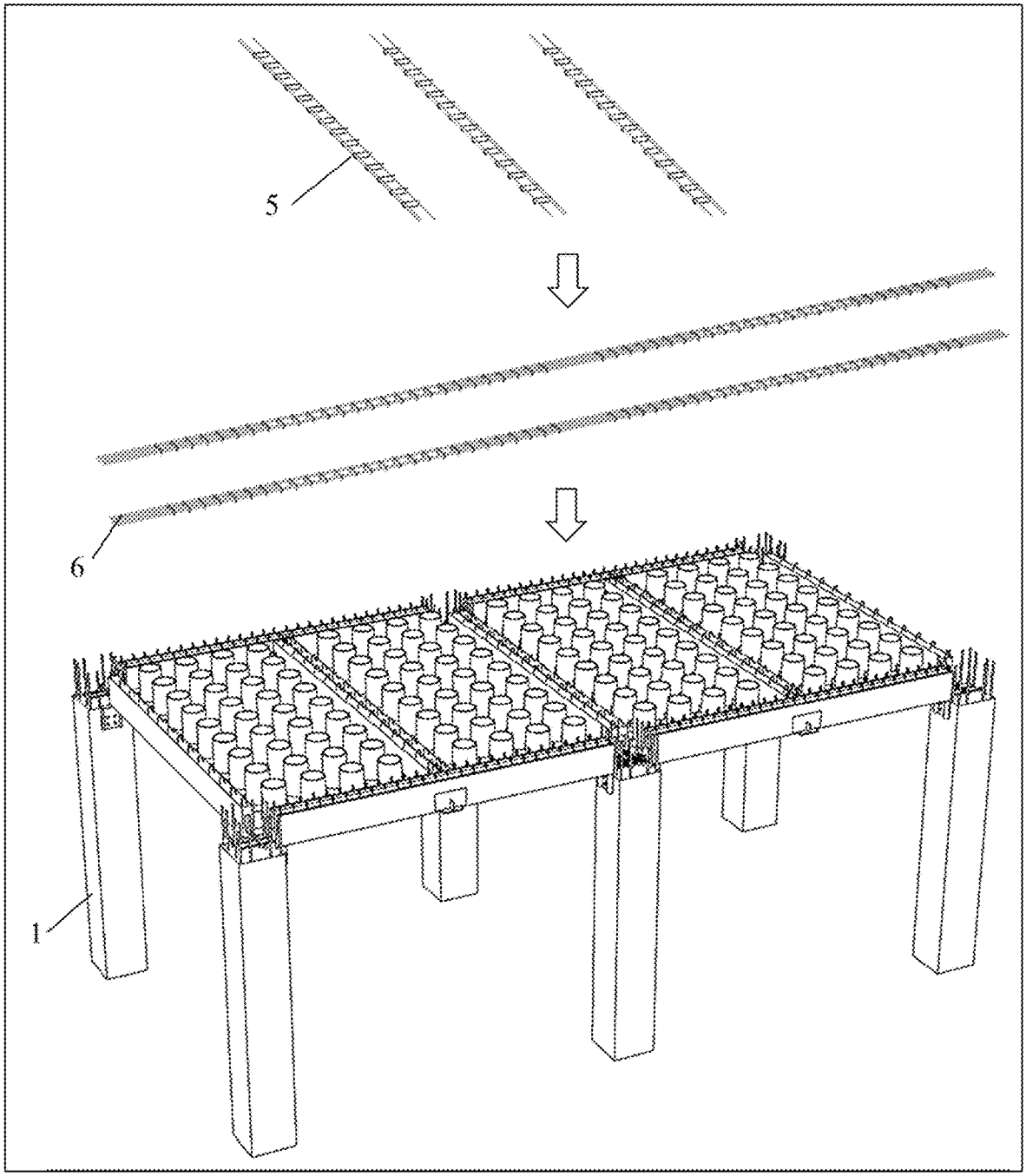
FIG. 18 illustrates a schematic diagram of construction procedures of a step 5 according to an embodiment of the disclosure.
Figure 19:
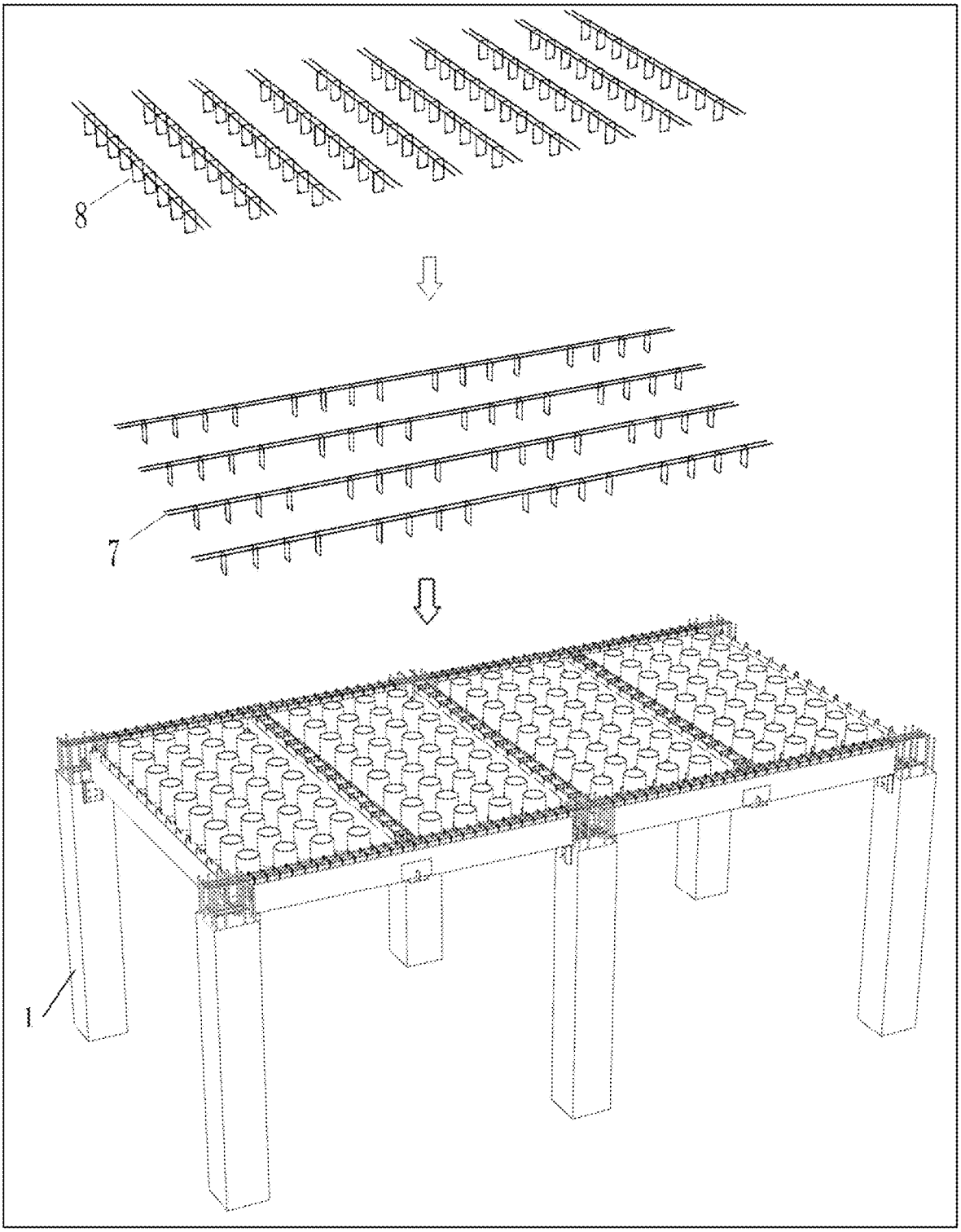
FIG. 19 illustrates a schematic diagram of construction procedures of a step 6 according to an embodiment of the disclosure.

As shown in FIG. 13, each horizontal slab rebar 7 includes upper horizontal rebars 71 and upper horizontal stirrups 72. Multiple upper horizontal rebars 71 extend left and right, multiple upper horizontal stirrups 72 are arranged in a left to right sequence, and the upper horizontal rebars 71 are connected to tops of the upper horizontal stirrups 72.

Figure 12:
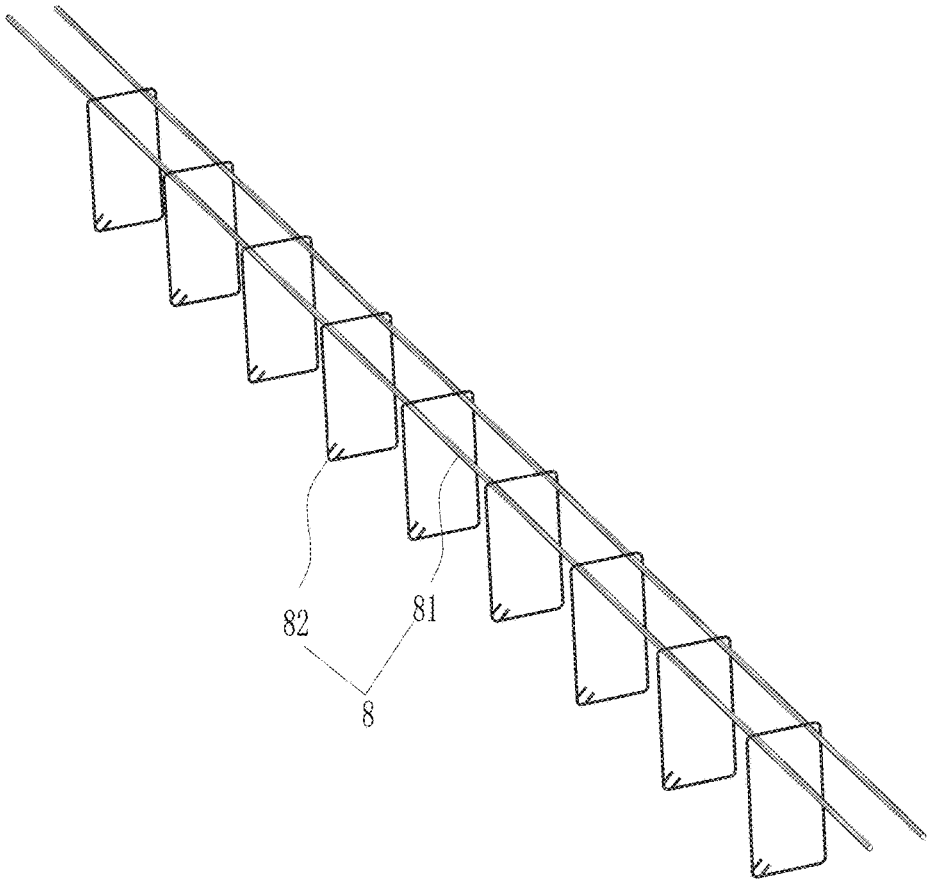
FIG. 12 illustrates a schematic structural diagram of a longitudinal slab rebar of the beam-slab integrated prefabricated waffle slab structure according to an embodiment of the disclosure.

As shown in FIG. 12, each longitudinal slab rebar 8 includes upper longitudinal rebars 81 and upper longitudinal stirrup 82. Multiple upper longitudinal rebars 81 extend forwards and backwards, multiple upper longitudinal stirrups 82 are arranged in a front to rear sequence, and the upper longitudinal rebars 81 are connected to tops of the upper longitudinal stirrups 82.

As shown in FIGS. 1 and 15-19, a construction method of the beam-slab integrated prefabricated waffle slab structure includes the following steps S1-S7.

In step S1, array construction of the columns 1 is completed.

In step S2, the beam and slab support element 11 and the beam support element 12 are installed on each of the columns 1 according to heights of the prefabricated frame beams 2 and the prefabricated waffle beam-slab units 3.

In step S3, each prefabricated frame beam 2 is installed on two of the columns 1 to make ends of each prefabricated frame beam 2 be supported on the beam support elements 12 of the two of the columns 1.

In step S4, each prefabricated waffle beam-slab unit 3 is installed on two of the prefabricated frame beams 2 to make the ribbed beam 32 on a side of each prefabricated waffle beam-slab unit 3 be supported on the beam-slab support elements 11 and make the ribbed beam 32 on another side of each prefabricated waffle beam-slab unit 3 be supported on the main support element 4.

In step S5, the L-shaped connecting element 9 is welded with the pre-embedded steel plate 36 and the main support element 4. The main beam top rebar skeletons 6 is installed in the groove 21 of each prefabricated frame beam 2, and the main beam top rebar skeletons 6 cover all of the prefabricated frame beams 2 in the same extension direction. The ribbed beam top rebar skeleton 5 is installed in the adjacent two of the ribbed beams 32 of two of the prefabricated waffle beam-slab units 3.

In step S6, the horizontal slab rebars 7 and the longitudinal slab rebars 8 are installed into each prefabricated waffle beam-slab unit 3 in sequence.

In step S7, the concrete is poured at the beam-column nodes of the columns 1 and the prefabricated frame beams 2, at the ribbed beam top rebar skeletons 5, at the main beam top rebar skeletons 6, at the horizontal slab rebars 7 and at the longitudinal slab rebars 8 on site, and the poured-on-site concrete is configured to cover the ribbed beam top rebar skeletons 5, the main beam top rebar skeletons 6, the horizontal slab rebars 7 and the longitudinal slab rebars 8.

Finally, it should be noted that the above descriptions are merely some of the embodiments of the disclosure and are not intended to limit the disclosure. Although the disclosure has been described in detail with reference to the aforementioned embodiments, it is still possible for those skilled in the art to modify the technical solutions described in the aforementioned embodiments, or to make equivalent substitutions for some of the technical features therein. Any modifications, equivalent substitutions, and improvements made within the spirit and principles of the disclosure should be included in the protection scope of the disclosure.

What is claimed is:

1. A beam-slab integrated prefabricated waffle slab structure, comprising:

columns (1), arranged in an array; wherein a beam and slab support element (11) and a beam support element (12) are disposed on an upper end of each of the columns (1);

prefabricated frame beams (2); wherein a cross section of each of the prefabricated frame beams (2) is rectangular, two ends of each of the prefabricated frame beams (2) are respectively disposed on the beam support elements (12) of adjacent columns (1) on left and right sides of each of the prefabricated frame beams (2), and a main support element (4) is disposed on front and rear sidewalls of each of the prefabricated frame beams (2);

prefabricated waffle beam-slab units (3), each comprising a reinforced concrete slab (31); wherein ribbed beams (32) are respectively disposed on left and right sides of the reinforced concrete slab (31) and are disposed facing upwards and extend forwards and backwards, and the reinforced concrete slab (31) defines through-holes (33) arranged in an array; annular rebars (34) extending out of the reinforced concrete slab (31) are disposed on front and rear sides and left and right sides of any one of the through-holes (33), and the annular rebar (34) between any adjacent two of the through-holes (33) is the same; an upper end of each of the through-holes (33) is provided with a cylindrical inner mold (35) to obtain array arranged cylindrical inner molds (35); a pre-embedded steel plate (36) is disposed on each of inner sidewalls of front and rear ends of each of the ribbed beams (32); and one of the ribbed beams (32) of each of the prefabricated waffle beam-slab units (3) is disposed on the beam and slab support elements (11), and another of the ribbed beams (32) of each of the prefabricated waffle beam-slab units (3) is disposed on the main support elements (4) of two mutually parallel prefabricated frame beams (2);

wherein each of the ribbed beams (32) is provided with beam stirrups (321), and the beam stirrups (321) extend out of an upper surface of each of the ribbed beams (32), and are arranged in a front to back sequence; and a post-installed ribbed beam top rebar skeleton (5) is disposed on an adjacent two of the ribbed beams (32) of two of the prefabricated waffle beam-slab units (3);

wherein a top surface of each of the prefabricated frame beams (2) defines a groove (21) extending along a length direction of each of the prefabricated frame beams (2); each of the prefabricated frame beams (2) is provided with opening hoops (22) extending out of the groove (21), and is provided with connecting rebars (23) extending out of front and rear sides of each of the prefabricated frame beams (2), the connecting rebars (23) are provided in multiple rows, and the multiple rows of the connecting rebars (23) are arranged in a left to right sequence; and each of the prefabricated frame beams (2) is provided with first longitudinal rebars (24) therein, and each of the first longitudinal rebars (24) extends into beam-column nodes of the columns (1) and the prefabricated frame beams (2);

wherein post-installed main beam top rebar skeletons (6) are disposed on the prefabricated frame beams (2), each of the main beam top rebar skeletons (6) is disposed continuously to cover all of the prefabricated frame beams (2) in a same extension direction, and each of the main beam top reinforcement skeletons (6) and the opening hoops (22) cooperate to form a closed hoop structure;

wherein an L-shaped connecting element (9) is disposed between the pre-embedded steel plate (36) and a corresponding one main support element (4), and the L-shaped connecting element (9) is welded with the pre-embedded steel plate (36) and the corresponding one main support element (4); in the array arranged cylindrical inner molds (35), horizontal slab rebars (7) are disposed between horizontal gaps of the array arranged cylindrical inner molds (35), and longitudinal slab rebars (8) are disposed between longitudinal gaps of the array arranged cylindrical inner molds (35);

wherein concrete is poured on site at the beam-column nodes of the columns (1) and the prefabricated frame beams (2), at the ribbed beam top rebar skeletons (5), at the main beam top rebar skeletons (6), at the horizontal slab rebars (7) and at the longitudinal slab rebars (8), and the poured-on-site concrete is configured to cover the ribbed beam top rebar skeletons (5), the main beam top rebar skeletons (6), the horizontal slab rebars (7) and the longitudinal slab rebars (8);

wherein the main support element (4) comprises two anchor plates (41), shear resistant steel plates (42), a connecting bottom plate (43) and vertical steel plates (44); the shear resistant steel plates (42) are fixed to an inner side surface of each of the two anchor plates (41), and the two anchor plates (41) are respectively disposed on front and rear side surfaces of each of the prefabricated frame beams (2); bottoms of the two anchor plates (41) are connected by the connecting bottom plate (43); and the main support element (4) and each of the prefabricated frame beams (2) are integrally cast and molded; and wherein front and rear edges of the connecting bottom plate (43) each extend out of the front and rear side surfaces of each of the prefabricated frame beams (2); each of the vertical steel plates (44) is connected to a middle of the connecting steel plate (43) and is connected to an outer side surface of each of the two anchor plates (41) to form an inversed T-shaped support structure, to thereby make two sides of each of the vertical steel plate (44) respectively support the ribbed beams (32) of corresponding reinforced concrete slabs (31).

2. The beam-slab integrated prefabricated waffle slab structure as claimed in claim 1, wherein rebars in each of the prefabricated waffle beam-slab units (3) comprise: multiple slab bottom horizontal rebars (37), multiple slab bottom longitudinal rebars (38) and ribbed beam rebars (39);

the multiple slab bottom horizontal rebars (37) are arranged horizontally in parallel intervals, the multiple slab bottom longitudinal rebars (38) are arranged longitudinally in parallel intervals, and the multiple slab bottom horizontal rebars (37) and the multiple slab bottom longitudinal rebars (38) are arranged in a staggered manner and are poured with the concrete, with reservation of the through-holes (33) to form the reinforced concrete slab (31), and the ribbed beam rebars (39) are poured with the concrete to form the ribbed beams (32);

each of the multiple slab bottom horizontal rebars (37) comprises multiple lower horizontal rebars (371) and multiple lower horizontal stirrups (372), the multiple lower horizontal rebar (371) extend left and right and are bent at two ends to form an anchorage structure extending into the ribbed beams (32), the multiple lower horizontal stirrups (372) are arranged in a left to right sequence, and the multiple lower horizontal rebars (371) are connected to bottoms of the multiple lower horizontal stirrups (372);

each of the multiple slab bottom longitudinal rebars (38) comprises multiple lower longitudinal rebars (381) and multiple lower longitudinal stirrups (382), the multiple lower longitudinal rebars (381) extend left and right, the multiple lower longitudinal stirrups (382) are arranged in a front to rear sequence, and the multiple lower longitudinal rebars (381) are connected to bottoms of the multiple lower longitudinal stirrups (382); and each of the ribbed beam rebars (39) comprises second longitudinal rebars (322) and ribbed beam stirrups, tops of the ribbed beam stirrups extend out of the upper surface of each of the ribbed beams (32) to form the beam stirrups (321); and the ribbed beams (32) cooperating with the beam and slab support elements (11) are provided with the second longitudinal rebars (322) therein, and the second longitudinal rebars (322) extend into the beam-column nodes of the columns (1) and the prefabricated frame beams (2).

3. The beam-slab integrated prefabricated waffle slab structure as claimed in claim 2, wherein front and rear end surfaces of the ribbed beams (32) cooperating with the beam and slab support elements (11) each define a shear resistant second keyway (323).

4. The beam-slab integrated prefabricated waffle slab structure as claimed in claim 1, wherein left and right end surfaces of each of the prefabricated frame beams (2) each define a shear resistant first keyway (25).

5. The beam-slab integrated prefabricated waffle slab structure as claimed in claim 1, wherein the beam and slab support element (11) and the beam support element (12) are steel corbels, and the steel corbels are locked on sidewalls of each of the columns (1).

6. The beam-slab integrated prefabricated waffle slab structure as claimed in claim 1, wherein each ribbed beam top rebar skeleton (5) comprises multiple first continuous rebars (51) and multiple closure stirrups (52); and the multiple first continuous rebars (51) are arranged in parallel, the multiple closure stirrups (52) are disposed between the multiple first continuous rebars (51), and are arranged along an extension direction of the multiple first continuous rebars (51) in sequence.

7. The beam-slab integrated prefabricated waffle slab structure as claimed in claim 1, wherein each main beam top rebar skeleton (6) comprises multiple second continuous rebars (61) and lacing wires (62); the multiple second continuous rebars (61) are arranged in an array, and the lacing wires (62) are disposed outside the multiple second continuous rebars (61); and the lacing wires (62) are arranged along an extension direction of the multiple second continuous rebars (61) in sequence.

8. The beam-slab integrated prefabricated waffle slab structure as claimed in claim 1, wherein each of the horizontal slab rebars (7) comprises multiple upper horizontal rebars (71) and multiple upper horizontal stirrups (72), the multiple upper horizontal rebars (71) extend left and right, the multiple upper horizontal stirrups (72) are arranged in a left to right sequence, and the multiple upper horizontal rebars (71) are connected to tops of the multiple upper horizontal stirrups (72); and each of the longitudinal slab rebars (8) comprises multiple upper longitudinal rebars (81) and multiple upper longitudinal stirrup (82), the multiple upper longitudinal rebars (81) extend left and right, the multiple upper longitudinal stirrups (82) are arranged in a front to rear sequence, and the multiple upper longitudinal rebars (81) are connected to tops of the multiple upper longitudinal stirrups (82).

9. A construction method of the beam-slab integrated prefabricated waffle slab structure as claimed in claim 1, comprising:

step 1, completing array construction of the columns (1);

step 2, installing the beam and slab support element (11) and the beam support element (12) on each of the columns (1) according to heights of the prefabricated frame beams (2) and the prefabricated waffle beam-slab units (3);

step 3, installing each of the prefabricated frame beams (2) on two of the columns (1) to make ends of each of the prefabricated frame beams (2) be supported on the beam support elements (12) of the two of the columns (1);

step 4, installing each of the prefabricated waffle beam-slab units (3) on two of the prefabricated frame beams (2) to make the ribbed beam (32) on a side of each of the prefabricated waffle beam-slab units (3) be supported on the beam-slab support elements (11) and make the ribbed beam (32) on another side of each of the prefabricated waffle beam-slab units (3) be supported on the main support element (4);

step 5, welding the L-shaped connecting element (9) with the pre-embedded steel plate (36) and the main support element (4); installing the main beam top rebar skeletons (6) in the groove (21) of each of the prefabricated frame beams (2), wherein the main beam top rebar skeletons (6) cover all of the prefabricated frame beams (2) in the same extension direction; and installing the ribbed beam top rebar skeleton (5) in the adjacent two of the ribbed beams (32) of two of the prefabricated waffle beam-slab units (3);

step 6, installing the horizontal slab rebars (7) and the longitudinal slab rebars (8) into each of the prefabricated waffle beam-slab units (3) in sequence; and step 7, pouring the concrete at the beam-column nodes of the columns (1) and the prefabricated frame beams (2), at the ribbed beam top rebar skeletons (5), at the main beam top rebar skeletons (6), at the horizontal slab rebars (7) and at the longitudinal slab rebars (8) on site, wherein the poured-on-site concrete is configured to cover the ribbed beam top rebar skeletons (5), the main beam top rebar skeletons (6), the horizontal slab rebars (7) and the longitudinal slab rebars (8).

* * * * *